United States Patent [19]

Wang

[11] Patent Number: 5,076,523

[45] **Date of Patent: * Dec. 31, 1991**

[54] TOWEL SUPPORT

[76] Inventor: Wen-Mu Wang, No. 32, Lane 266, Fu Te I Rd., Hsi Tze Chien, Taipei Hsien, Taiwan

[ * ] Notice: The portion of the term of this patent subsequent to Mar. 13, 2007 has been disclaimed.

[21] Appl. No.: 738,364

[22] Filed: Jul. 31, 1991

[51] Int. Cl.[5] ..... A47G 29/00

[52] U.S. Cl. ..... 248/222.1; 248/251

[58] Field of Search ..... 248/222.1, 251, 201, 248/224.3

[56] References Cited

U.S. PATENT DOCUMENTS

| | | | |
|---|---|---|---|
| 1,636,364 | 7/1927 | Hoegger | 248/222.1 |
| 1,773,815 | 8/1930 | Hoegger | 248/222.1 |
| 1,891,048 | 12/1932 | Keefe | 248/222.1 |
| 3,406,455 | 10/1968 | Alcins, Jr. | 248/222.1 X |
| 4,907,771 | 3/1990 | Wang | 248/222.1 |
| 5,026,012 | 6/1991 | Wang | 248/222.1 |

*Primary Examiner*—Alvin C. Chi-Shue

*Attorney, Agent, or Firm*—Varndell Legal Group

[57] ABSTRACT

A towel support comprising a wall plate mounted onto a wall surface by anchors and screws, a connector to connect a hanging device to a toothed stem on said wall plate, wherein said connector has an axial hole into which said stem is inserted, a bolt hole vertically in communication with said axial hole, and a screw rod movably fastened in the gap between either two teeth on said stem to firmly secure said connector to said stem and prohibit it from rotary motion.

1 Claim, 6 Drawing Sheets

TOWEL SUPPORT

BACKGROUND AND SUMMARY OF THE INVENTION

The present invention relates to towel supports and relates more particularly to a towel support in which the stem of the mounting member has teeth around the peripheral face thereof in longitudinal direction into which as screw rod is fastened through a connector to secure a hanging device thereto and to simultaneously prohibit the mounting member from displacement in radial direction.

U.S. Pat. No. 4,907,771 discloses a hanger for holding towels, which includes a mounting plate fastened in a wall by anchors, and a connector connected with the stem of said mounting plate. In this structure of hanger as shown in FIG. 1, the holes on the wall mounting plate must be accurately aligned with the anchors for fastening. If the anchors are not accurately positioned, the screws will be difficult to fix the mounting plate onto the wall. U.S. Pat. No. 1,887,686 discloses a fixture support for supporting things on a wall which, as shown in FIG. 2, has a supporting member attached to a supporting surface and a supported member fitting over the supporting member. In this structure of fixture support, the mounting holes of the supporting member must be accurately aligned with the corresponding anchors within a wall so that screws can be fastened to secure the mounting member in place and, the supported member shall also be accurately aligned with the groove on the stem of the supporting member so that a screw can be threaded in to secure the mounted member to the mounting member. U.S. Pat. No. 5,026,012 discloses a towel support which includes a wall plate having a projecting stem and elongated mounting holes for easy alignment of flat head screws with anchors which are secured inside a wall to fasten the wall plate onto the wall, and a connector to secure a handing device to said mounting plate for holding towels. The connector has a bolt hole vertically through which a screw rod is fastened to stop the top taper end of the stem of the wall plate so as to firmly secure the connector to the wall plate. This structure of towel support eliminates the aforesaid alignment problems. However, the screw rod which secures the connector to the stem of the wall plate can not prohibit the connector from displacement in radial direction. The present invention has been accomplished to provide an improvement on the towel support disclosed in U.S. Pat. No. 5,026,012, which was also invented by the present inventor. In the present invention, the stem of the mounting member onto which a connector is secured by a screw rod to hold a hanging device has elongated teeth around the peripheral surface thereof in longitudinal direction. By screwing down the screw rod permitting the bottom cone thereof to engage in the gap between either two teeth, the connector is prohibited from rotary motion.

DETAILED DESCRIPTION OF THE PREFERRED EMBODIMENT

Figure 2:
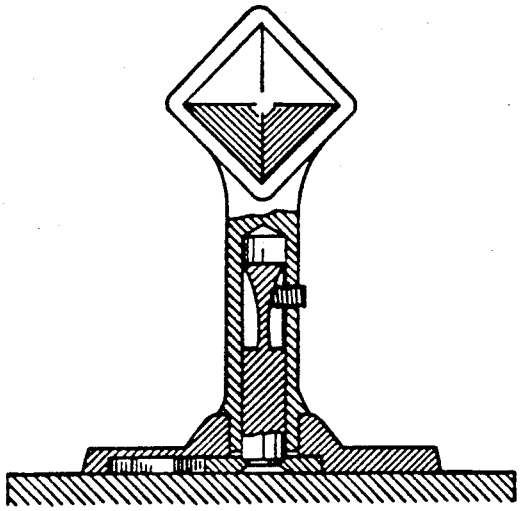
Fig. 2 PRIOR ART
FIG. 2 is a sectional view of the fixture support as disclosed in U.S. Pat. No. 1,997,686.
Figure 1:
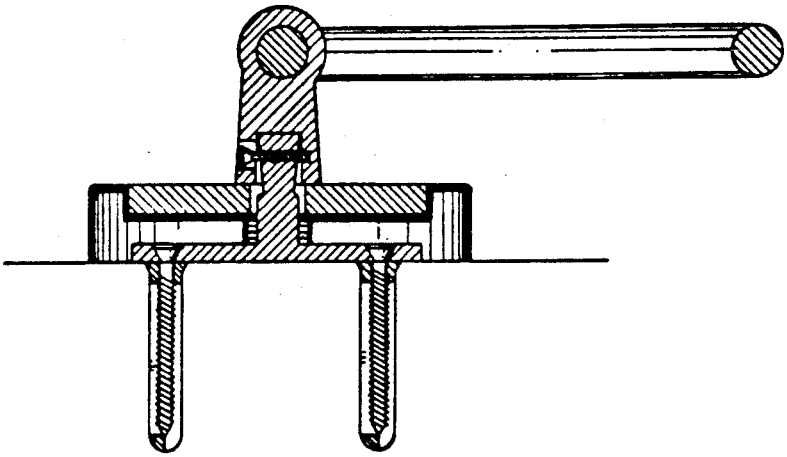
Fig. 1 PRIOR ART
FIG. 1 is a sectional view of the hanger for holding towels as disclosed in U.S. Pat. No. 4,907,771.
Figure 3:
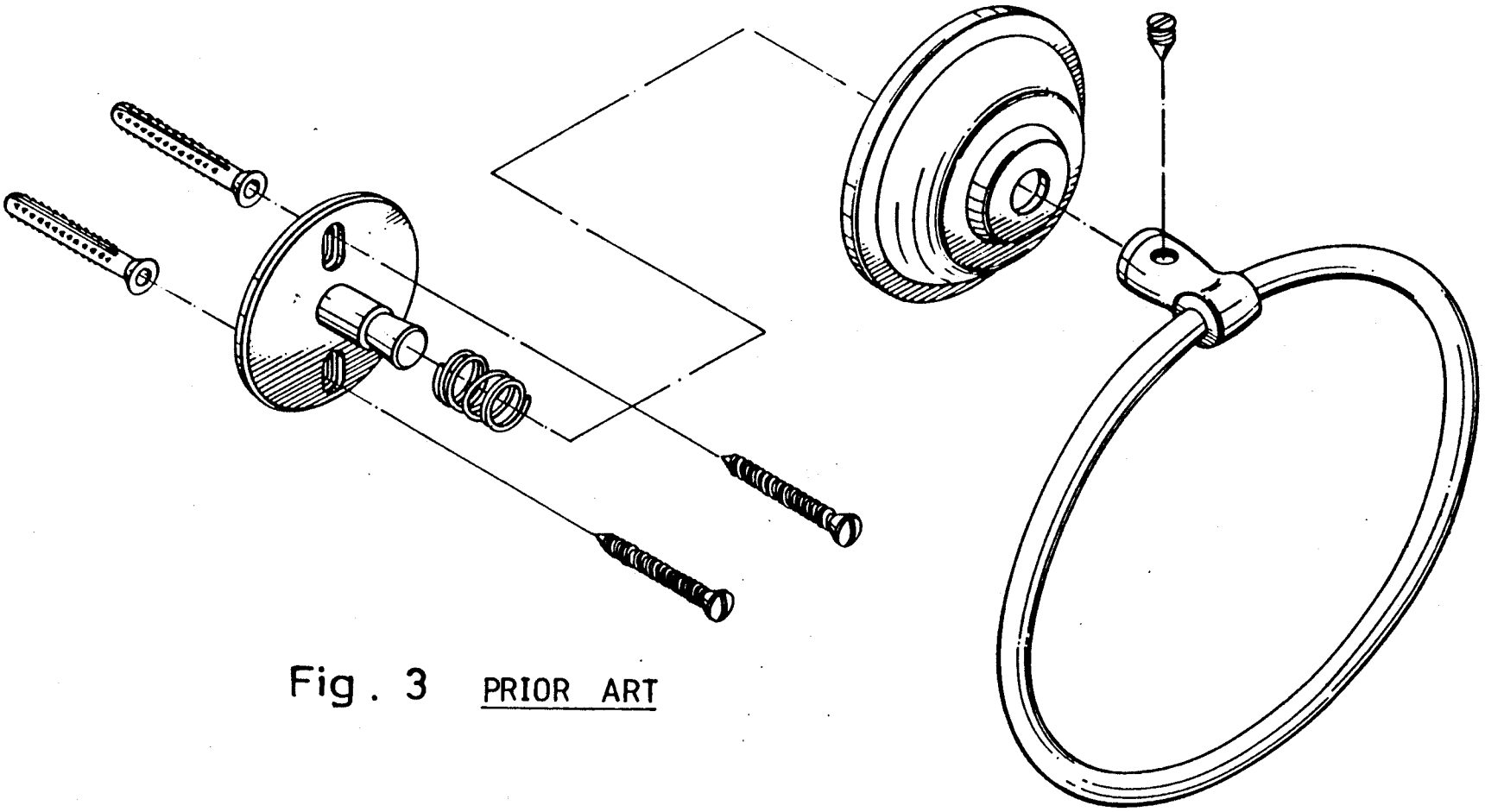
Fig. 3 PRIOR ART
FIG. 3 is an exploded perspective view of the towel support as disclosed in U.S. Pat. No. 5,026,012.
Figure 4:
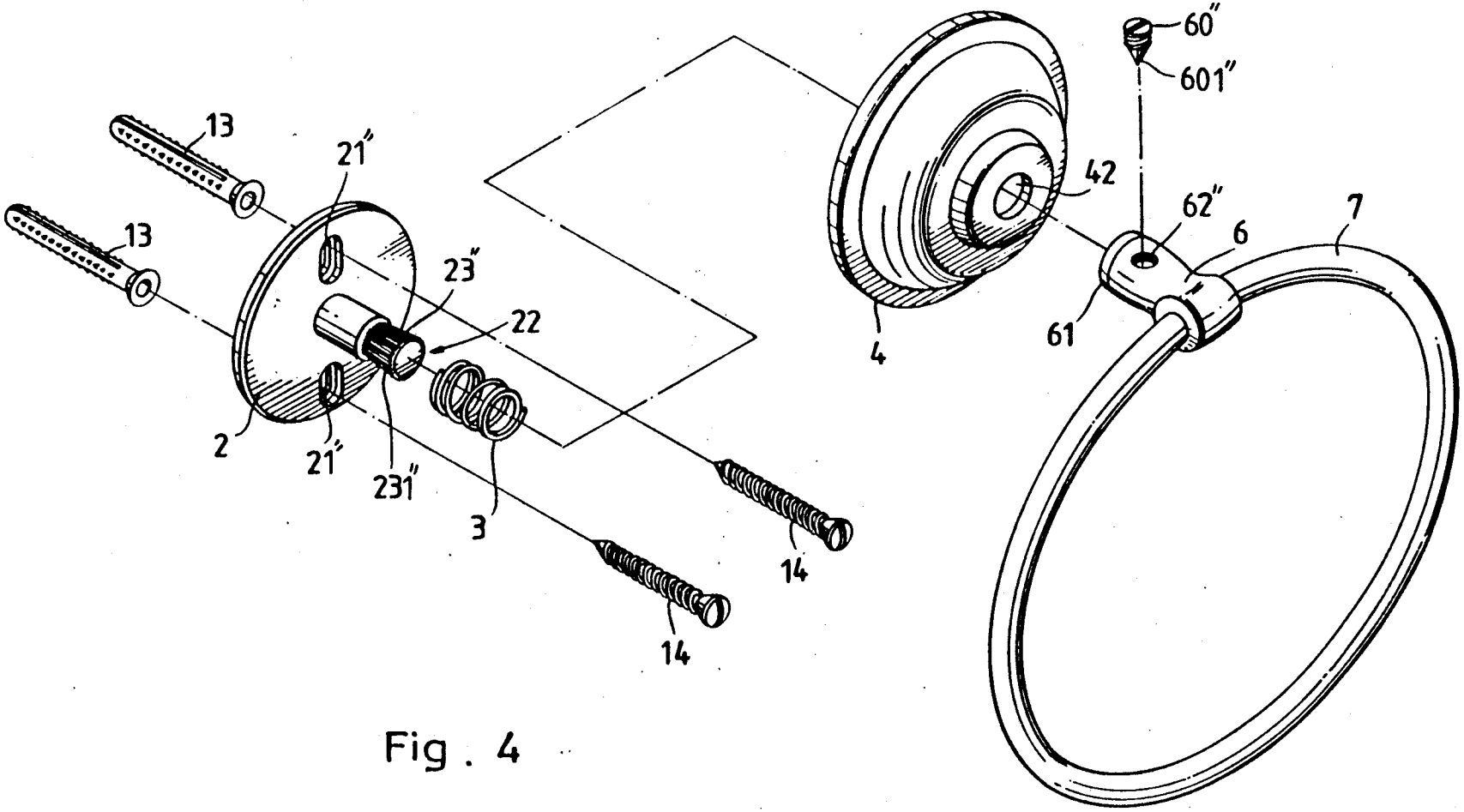
FIG. 4 is an exploded perspective view of the towel support as constructed according to the present invention.
Figure 5:
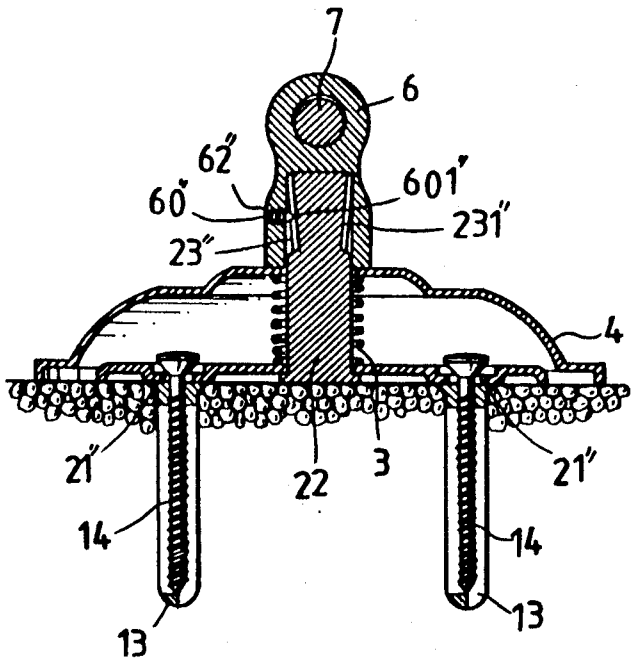
FIG. 5 is a sectional view showing that the present invention has been mounted onto a wall.

Referring to FIGS. 4 and 5, a towel support in accordance with the present invention includes a rigid mounting member 2 comprising a wall plate having elongated mounting holes 21" to respectively match with anchors 13 set inside wall surface for easy fixation of the mounting member 2 onto the wall by means of flat head screws 14, and a stem 22 upstanding from its center. Because of the design of the elongated mounting holes 21", a more flexible range is provided in aligning the mounting holes 21" with the anchors 12 so that the flat head screws 14 can be straightly inserted in the anchors 13 to secure the mounting member 2 to the wall. After the mounting member is fixed onto the wall, a spring 3 is sleeved on the stem 22 of the mounting member 2, and a cover 4 which has a center hole 42 is covered on the mounting member 2 permitting the stem 22 to protrude beyond its center hole for the connection thereto of a hanging device 7 through a connector 6. The hanging device 7 has a ring shaped body suitable for hanging towels, and the connector 6 is fixedly mounted on the hanging device 7 for securing the hanging device 7 to the stem 22 of the mounting member 2 to squeeze the spring 3 and the cover plate 4 in therebetween. The connector 6 has an axial hole 61 for receiving the stem 22 of the mounting member 2, a bolt hole 62" vertically in communication with the axial hole 61, and a screw rod 60" movably secured in the bolt hole 62". The stem 22 of the mounting member 2 has a tapered front end 23" which has a plurality of elongated teeth 231" around the peripheral surface thereof in longitudinal direction. The screw rod 60" has a cone 601" at the bottom. By screwing down the screw rod 60" onto the tapered front end 23" of the stem 22 permitting the cone 601" to be engaged in the gap between either two teeth 231" on the tapered front end 23" of the stem 22, the connector 6 is firmly secured to the mounting member 2 and prohibited from rotary motion relative to the stem 22.

Figure 6:
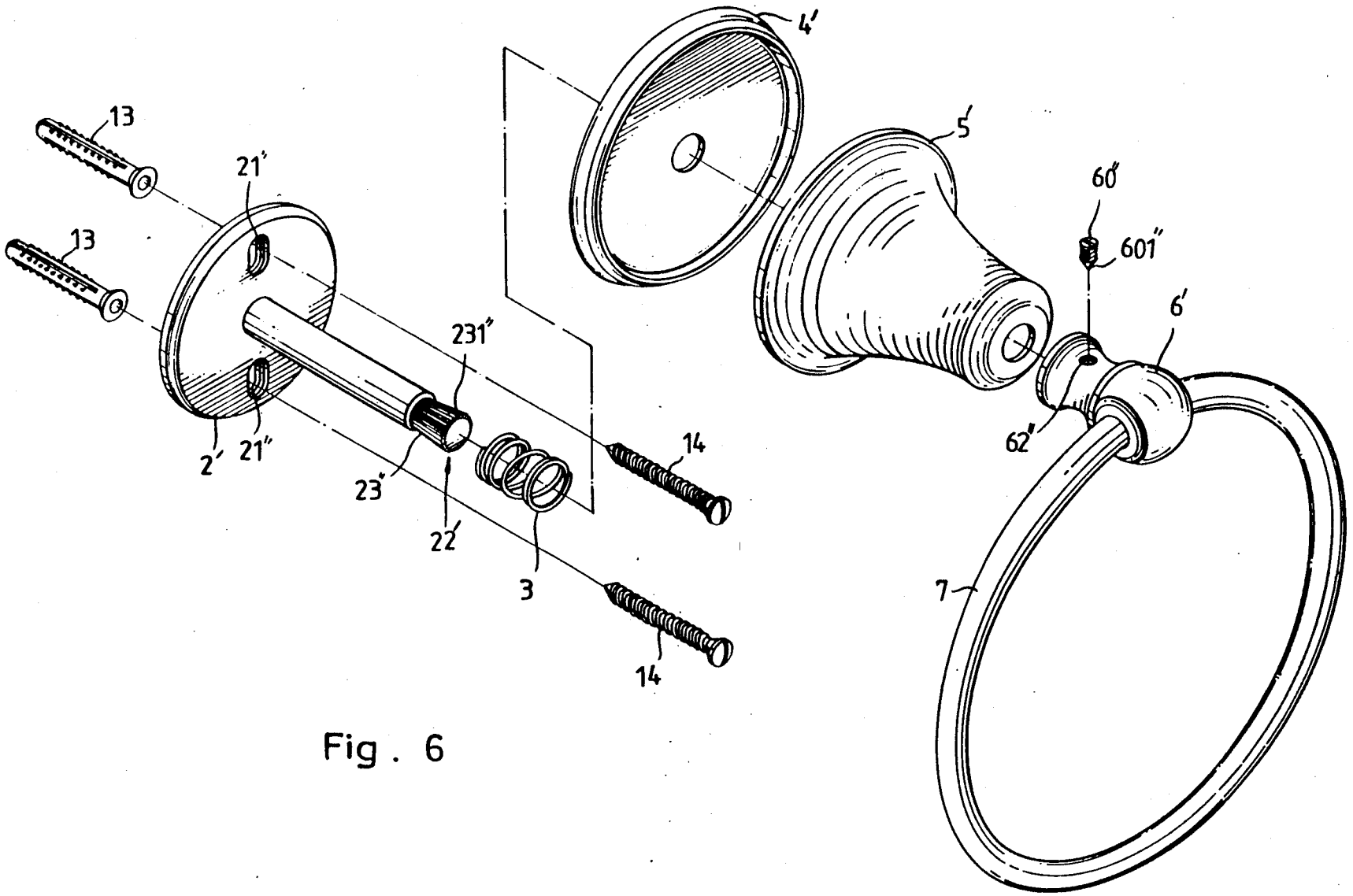
FIG. 6 is an exploded perspective view of a second embodiment of the present invention.
Figure 7:
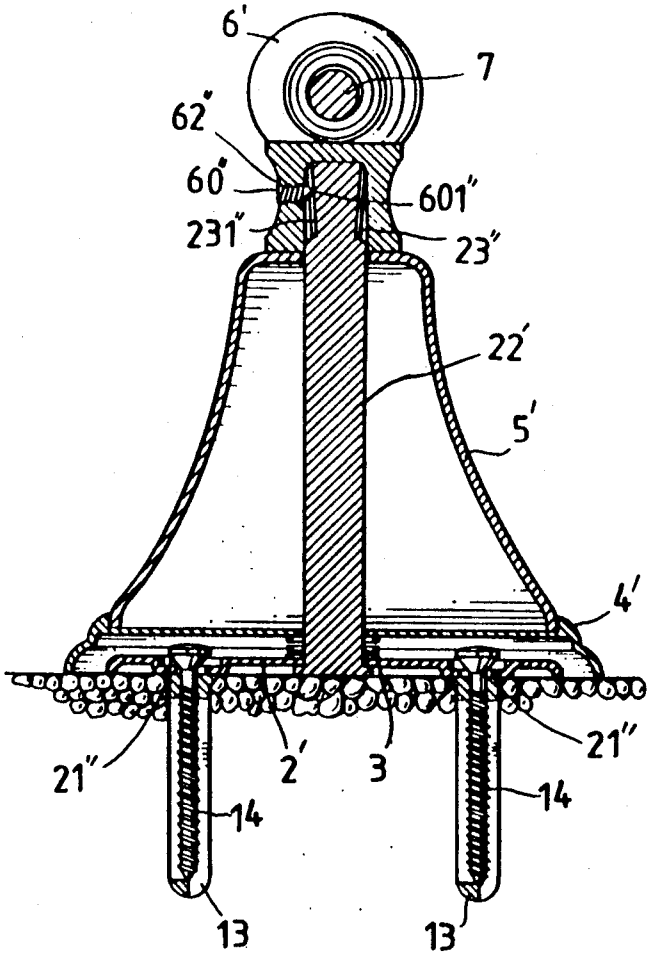
FIG. 7 is a sectional view showing that the second embodiment of the present invention has been mounted onto a wall.

Referring to FIGS. 6 and 7, therein illustrated is an alternate form of the present invention, in which the stem 22' is extended so that an ornamental device 5' can be attached to the cover plate 4' by the connector 6'.

I claim:

1. A towel support comprising a rigid mounting member mounted onto a wall surface by anchors and flat head screws, said rigid mounting member having a stem extending from its center; a cover plate covering on said mounting member, said cover plate having a center hole through which said stem protrudes; a spring sleeved on said stem and retained between said mounting member and said cover plate; a connector comprising an axial hole for receiving said stem, a bolt hole vertically in communication with said axial hole, and a screw rod movable fastening in said bolt hole to secure said connector to said stem; a hanging device fixedly secured to said connector for holding towels; and characterized in that said stem has a tapered front end, said tapered front end having a plurality of elongated teeth around the peripheral surface thereof in longitudinal direction; said screw rod has a cone at the bottom releasably engaged in the gap between either two of said elongated teeth to prohibit said connector from displacement on said stem in radial direction.

* * * * *